US011980225B2

(12) United States Patent
Yoon et al.

(10) Patent No.: US 11,980,225 B2
(45) Date of Patent: May 14, 2024

(54) CARTRIDGE AND AEROSOL GENERATING DEVICE INCLUDING THE SAME

(71) Applicant: KT&G CORPORATION, Daejeon (KR)

(72) Inventors: Sung Wook Yoon, Suwon-si (KR); Jae Min Lee, Siheung-si (KR); Jong Sub Lee, Seongnam-si (KR); Dae Nam Han, Daejeon (KR); Dong Bum Kwon, Seoul (KR); Jin Soo Seong, Seoul (KR); Won Kyeong Lee, Guri-si (KR)

(73) Assignee: KT&G CORPORATION, Daejeon (KR)

( * ) Notice: Subject to any disclaimer, the term of this patent is extended or adjusted under 35 U.S.C. 154(b) by 835 days.

(21) Appl. No.: 16/982,319

(22) PCT Filed: Apr. 8, 2020

(86) PCT No.: PCT/KR2020/004746
§ 371 (c)(1),
(2) Date: Sep. 18, 2020

(87) PCT Pub. No.: WO2021/020692
PCT Pub. Date: Feb. 4, 2021

(65) Prior Publication Data

US 2023/0105938 A1 Apr. 6, 2023

(30) Foreign Application Priority Data

Jul. 29, 2019 (KR) ..... 10-2019-0091998

(51) Int. Cl.
*A24F 40/42* (2020.01)
*A24F 40/10* (2020.01)

(52) U.S. Cl.
CPC ..... *A24F 40/42* (2020.01); *A24F 40/10* (2020.01)

(58) Field of Classification Search
CPC ..... A24F 40/42; A24F 40/10
(Continued)

(56) References Cited

U.S. PATENT DOCUMENTS 4,139,792 A * 2/1979 Kondo ..... H02N 2/183 361/260
7,959,468 B2 * 6/2011 Yong ..... H01R 13/65918 439/607.41

(Continued)

FOREIGN PATENT DOCUMENTS

CN 108185536 A 6/2018
EP 3488715 A2 5/2019

(Continued)

OTHER PUBLICATIONS

Extended European Search Report dated Aug. 19, 2021 in Application No. 20768243.6.

(Continued)

*Primary Examiner* — Harshad C Patel
(74) *Attorney, Agent, or Firm* — Sughrue Mion, PLLC

(57) ABSTRACT

A cartridge for mounting on a main body of an aerosol generating device includes: a liquid storage extending in a longitudinal direction of the cartridge to form an outer wall of the cartridge, the liquid storage including a space accommodating a liquid composition therein; a heater that heats the liquid composition accommodated in the liquid storage to generate an aerosol; and a coupling protrusion including an elastic material, the coupling protrusion protruding from an outer surface of the liquid storage and coupling the main body to the cartridge.

7 Claims, 5 Drawing Sheets

(58) Field of Classification Search
USPC ..... 131/329
See application file for complete search history.

(56) References Cited

U.S. PATENT DOCUMENTS

| | | | | |
|---|---|---|---|---|
| 8,128,427 | B2 * | 3/2012 | Mochizuki | H01R 4/183 439/419 |
| 10,426,199 | B2 * | 10/2019 | Turner | A24F 40/42 |
| 11,155,402 | B2 * | 10/2021 | Caldas | B65D 77/0493 |
| 2012/0318283 | A1 * | 12/2012 | Watanabe | A24F 42/60 131/191 |
| 2016/0192710 | A1 | 7/2016 | Liu | |
| 2017/0231282 | A1 | 8/2017 | Bowen et al. | |
| 2018/0116291 | A1 | 5/2018 | Monsees et al. | |
| 2018/0289061 | A1 | 10/2018 | Mo et al. | |
| 2018/0310616 | A1 * | 11/2018 | Clemens | A24F 40/40 |
| 2019/0045833 | A1 | 2/2019 | Saygili | |
| 2019/0083720 | A1 | 3/2019 | Leadley et al. | |
| 2019/0174827 | A1 * | 6/2019 | Fernando | H05B 3/44 |
| 2019/0254345 | A1 * | 8/2019 | Hepworth | A24F 40/40 |
| 2019/0335813 | A1 | 11/2019 | Qiu | |
| 2020/0367557 | A1 | 11/2020 | Lin et al. | |
| 2021/0186088 | A1 | 6/2021 | Li et al. | |

FOREIGN PATENT DOCUMENTS

| | | | |
|---|---|---|---|
| JP | 2009-98409 | A | 5/2009 |
| JP | 3217944 | U | 9/2018 |
| KR | 10-2011-0079589 | A | 7/2011 |
| KR | 20-0454619 | Y1 | 7/2011 |
| KR | 10-2018-0103878 | A | 9/2018 |
| WO | 2013/171206 | A1 | 11/2013 |
| WO | 2015/157900 | A1 | 10/2015 |
| WO | 2016/041209 | A1 | 3/2016 |
| WO | 2018050612 | A1 | 3/2018 |
| WO | 2018/086406 | A1 | 5/2018 |
| WO | 2018/130068 | A1 | 7/2018 |

OTHER PUBLICATIONS

Chinese Office Action dated Mar. 27, 2023 cited in CN Application No. 202080002333.1.

Office Action dated Jan. 4, 2022 from the Japanese Patent Office in JP Application No. 2020-562159.

Written Opinion for PCT/KR2020/004746, dated Jul. 22, 2020.

International Search Report for PCT/KR2020/004746, dated Jul. 22, 2020.

Office Action dated Sep. 7, 2023 in Chinese Application No. 202080002333.1.

Office Action issued Jan. 22, 2024 in Chinese Application No. 202080002333.1.

* cited by examiner

[Fig. 1]
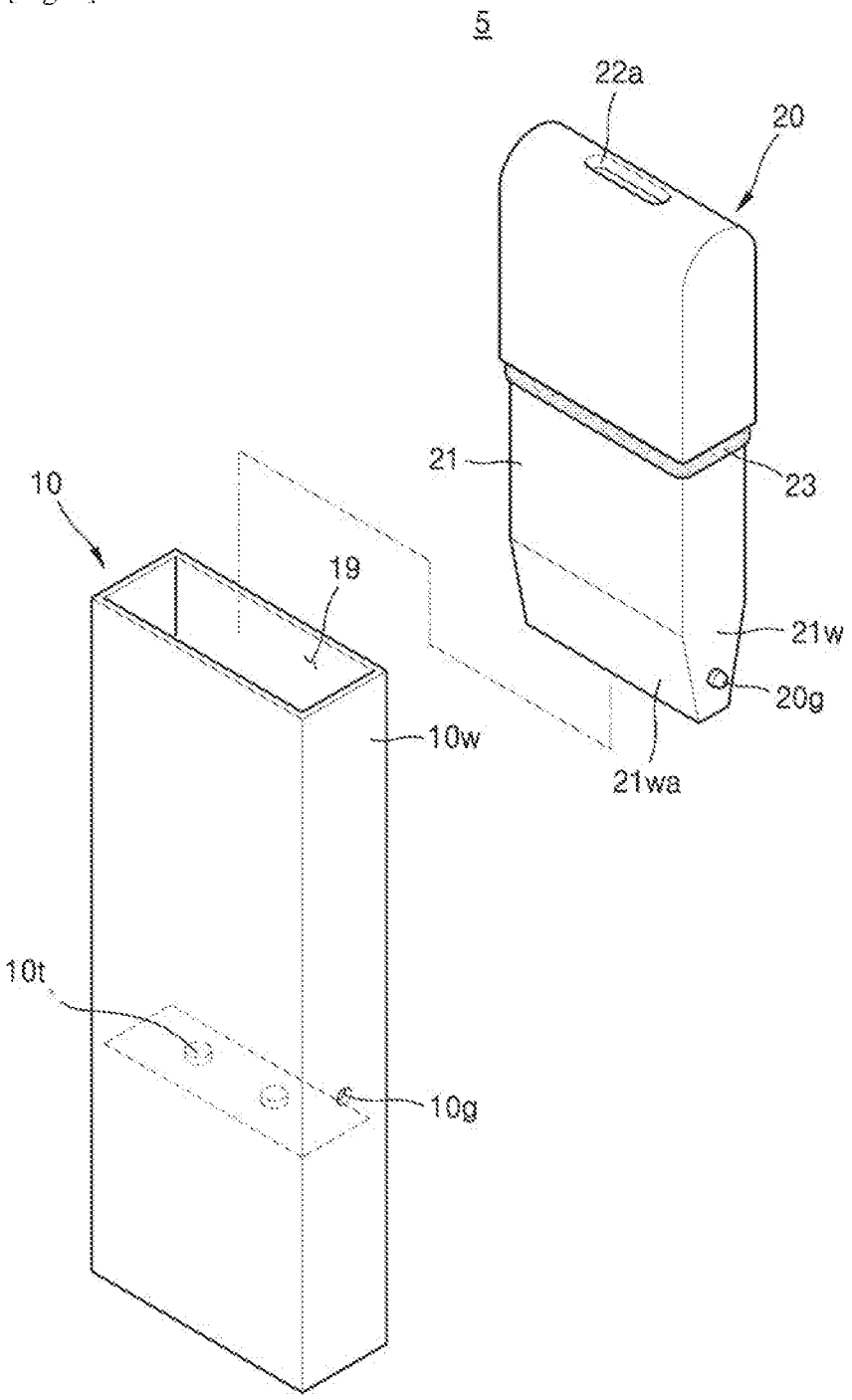

[Fig. 2]
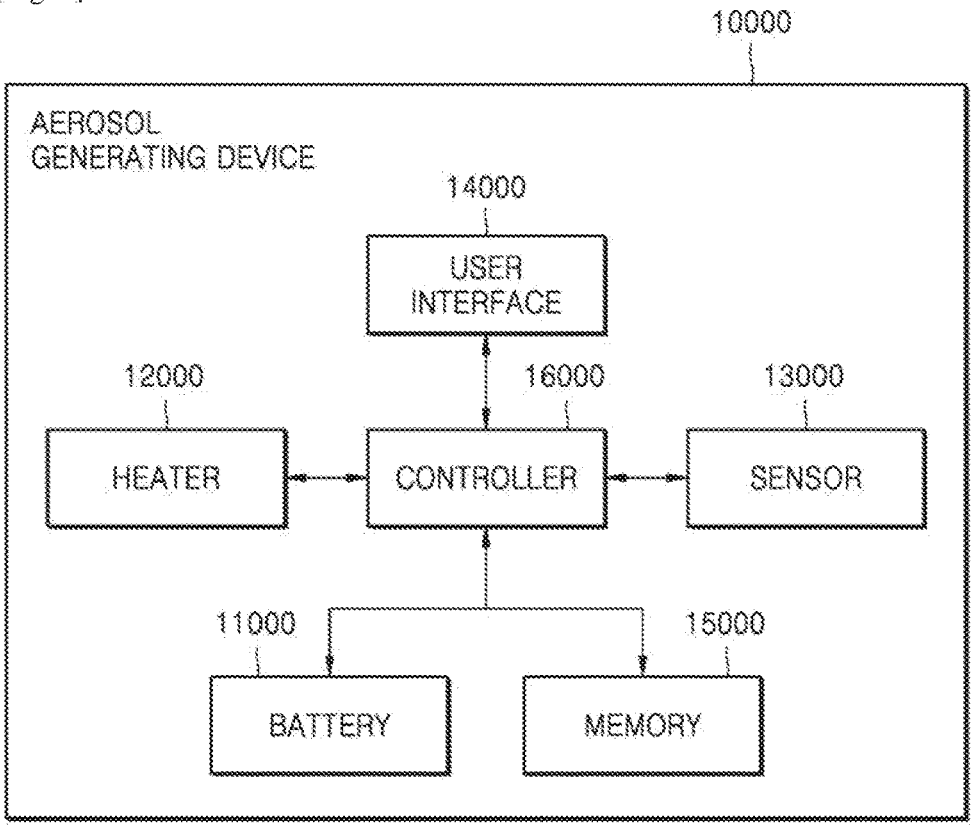
[Fig. 3]
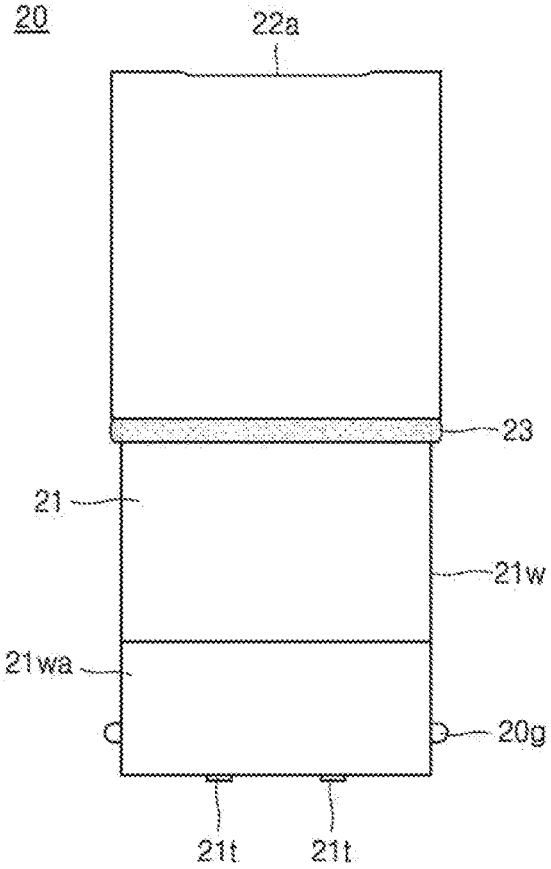

[Fig. 4]
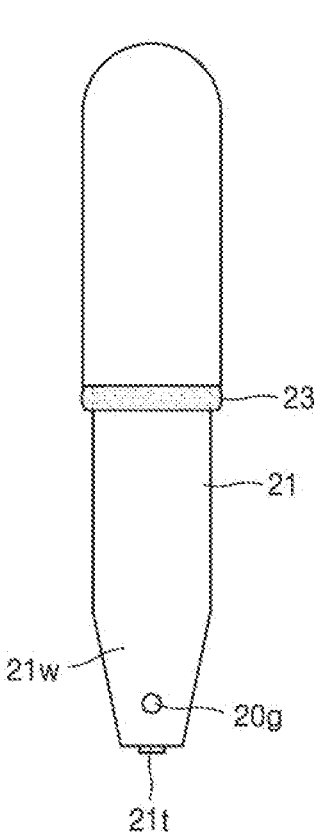
[Fig. 5]
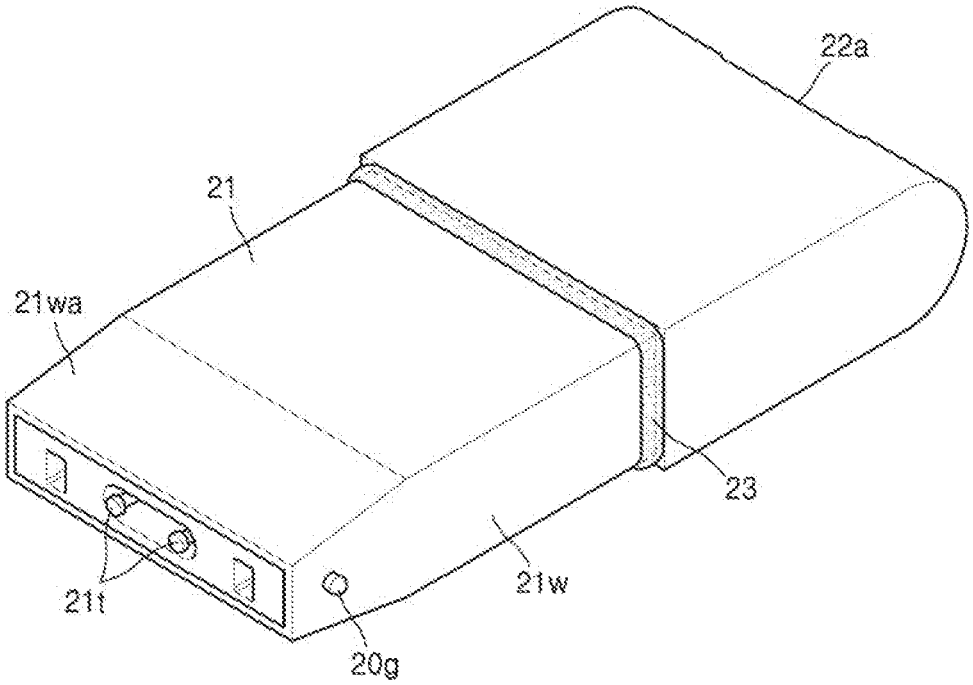

[Fig. 6]
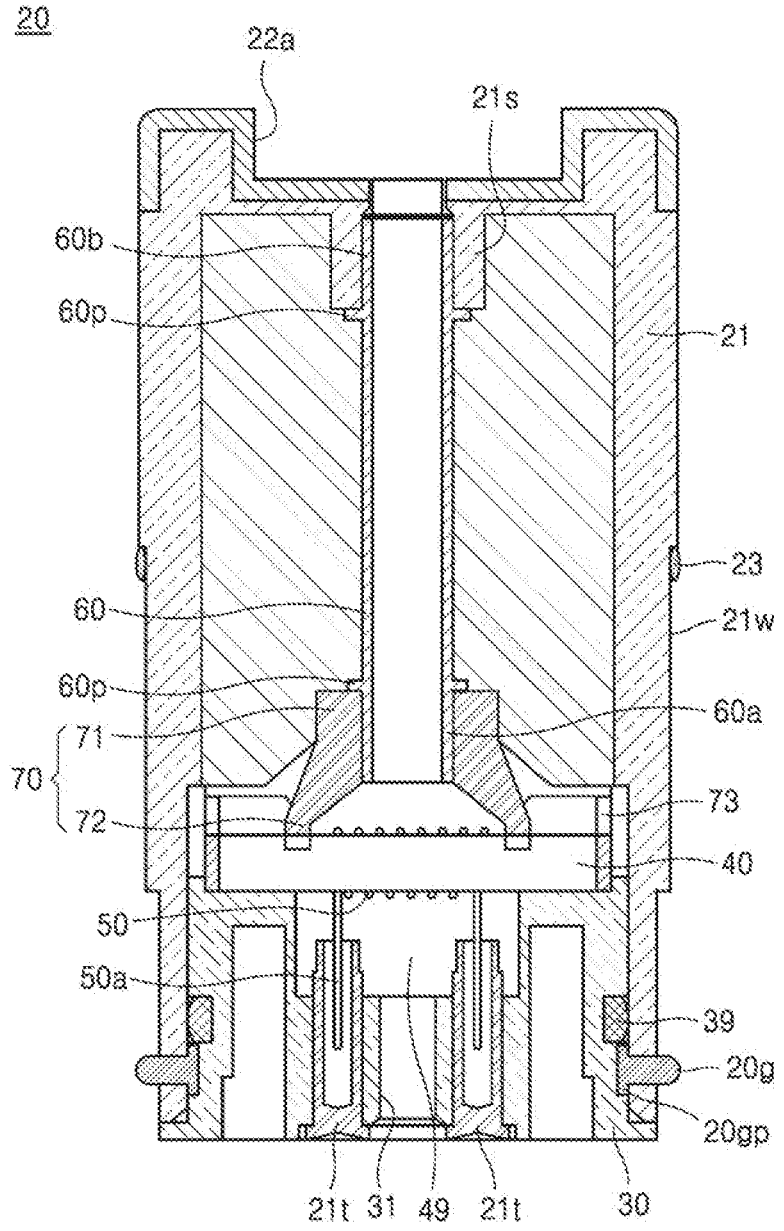

[Fig. 7]
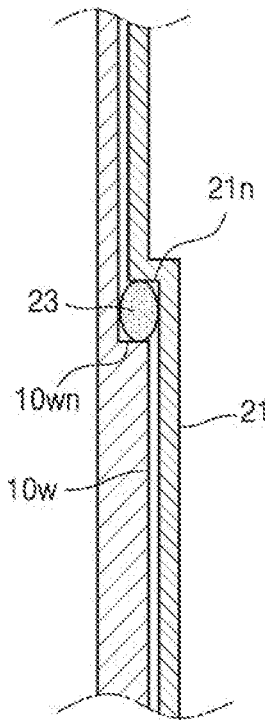
[Fig. 8]
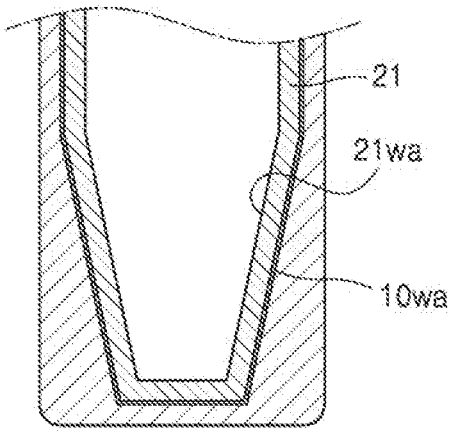

CARTRIDGE AND AEROSOL GENERATING DEVICE INCLUDING THE SAME

CROSS REFERENCE TO RELATED APPLICATIONS

This application is a National Stage of International Application No. PCT/KR2020/004746 filed Apr. 8, 2020, claiming priority based on Korean Patent Application No. 10-2019-0091998 filed Jul. 29, 2019.

TECHNICAL FIELD

The present disclosure relates to a cartridge and an aerosol generating device including the cartridge.

BACKGROUND ART

Recently, the demand for alternative methods to overcome the shortcomings of general combustive-type cigarettes has increased. For example, there is a growing demand for a method of generating aerosol by heating an aerosol generating material, rather than by burning cigarettes.

The aerosol generating device may include a cartridge accommodating a liquid composition therein. The cartridge may be detachably coupled to the aerosol generating device. Accordingly, there is a need for a design relating to a structure for coupling a cartridge to an aerosol generating device.

DISCLOSURE OF INVENTION

Solution to Problem

Provided is a coupling structure between a cartridge and an aerosol generating device.

The technical goal of the present disclosure is not limited thereto, and other technical goals may be inferred from the following embodiments.

Additional aspects will be set forth in part in the description which follows and, in part, will be apparent from the description, or may be learned by practice of the presented embodiments of the disclosure.

According to an aspect of an embodiment, a cartridge for mounting on a main body of an aerosol generating device includes: a liquid storage extending in a longitudinal direction of the cartridge and including a space for accommodating a liquid composition; a heater configured to heat the liquid composition accommodated in the liquid storage to generate aerosol; and a coupling protrusion comprising an elastic material, protruding from an outer surface of the liquid storage, and configured to couple the main body to the cartridge by being inserted into a coupling hole formed on the main body.

BRIEF DESCRIPTION OF DRAWINGS

The above and other aspects, features, and advantages of certain embodiments of the disclosure will be more apparent from the following description taken in conjunction with the accompanying drawings, in which:

FIG. 1 is an exploded perspective view schematically illustrating a coupling relationship between a replaceable cartridge holding an aerosol generating material and an aerosol generating device including the cartridge, according to an embodiment;

FIG. 2 is a block diagram schematically illustrating a hardware configuration of the aerosol generating device according to the embodiment shown in FIG. 1;

FIG. 3 is a front view of the cartridge, which holds an aerosol generating material and is replaceable, according to the embodiment shown in FIG. 1;

FIG. 4 is a side view of the cartridge according to the embodiment shown in FIG. 3;

FIG. 5 is a perspective view of the cartridge according to the embodiment shown in FIG. 3;

FIG. 6 is a cross-sectional view of the cartridge according to the embodiment shown in FIGS. 3 to 5; and FIGS. 7 and 8 schematically illustrate portions of the structure of the aerosol generating device according to the embodiment shown in FIG. 1.

BEST MODE FOR CARRYING OUT THE INVENTION

According to an aspect of an embodiment, a cartridge for mounting on a main body of an aerosol generating device includes: a liquid storage extending in a longitudinal direction of the cartridge and including a space for accommodating a liquid composition; a heater configured to heat the liquid composition accommodated in the liquid storage to generate aerosol; and a coupling protrusion comprising an elastic material, protruding from an outer surface of the liquid storage, and configured to couple the main body to the cartridge by being inserted into a coupling hole formed on the main body.

The color of the coupling protrusion may represent a type of the liquid composition accommodated in the liquid storage.

The liquid storage may include a stepped surface formed in the longitudinal direction of the cartridge, and the cartridge may further include a shielding ring arranged on the stepped surface of the liquid storage.

The liquid storage may include a tapered portion of which width tapers off in the longitudinal direction of the cartridge.

According to an aspect of another embodiment, an aerosol generating device includes: a cartridge comprising: a liquid storage extending in a longitudinal direction of the cartridge and including a space for accommodating a liquid composition; a heater configured to heat the liquid composition accommodated in the liquid storage; and a coupling protrusion comprising an elastic material and protruding from an outer surface of the liquid storage; and a main body comprising: an accommodation space into which the cartridge is inserted; and a coupling hole arranged on a side wall surrounding the accommodation space so that the coupling protrusion is inserted into the coupling hole while the cartridge is accommodated in the accommodation space.

The liquid storage may include a stepped surface formed in the longitudinal direction of the cartridge, the main body may include a step formed on an inner wall of the main body and having a shape corresponding to the stepped surface of the liquid storage, and a shielding ring may be arranged on the stepped surface of the liquid storage such that the shielding ring is located between the stepped surface of the liquid storage and the step of the inner wall while the cartridge is inserted into the accommodation space.

The liquid storage may include a tapered portion of which width tapers off in the longitudinal direction of the cartridge, and the inner wall of the main body may have a shape corresponding to the tapered portion of the liquid storage so that the cartridge is wedged in the main body.

MODE FOR THE INVENTION

Reference will now be made in detail to embodiments, examples of which are illustrated in the accompanying drawings, wherein like reference numerals refer to like elements throughout. In this regard, the present embodiments may have different forms and should not be construed as being limited to the descriptions set forth herein. Accordingly, the embodiments are merely described below, by referring to the figures, to explain aspects of the present description. As used herein, the term "and/or" includes any and all combinations of one or more of the associated listed items. Expressions such as "at least one of." when preceding a list of elements, modify the entire list of elements and do not modify the individual elements of the list.

With respect to the terms used to describe the various embodiments, general terms which are currently and widely used are selected in consideration of functions of structural elements in the various embodiments of the present disclosure. However, meanings of the terms can be changed according to intention, a judicial precedence, the appearance of new technology, and the like. Also, some terms may be arbitrarily selected by the applicant. In this case, the meaning of the selected terms will be described in the detailed description. Thus, the terms used herein have to be defined based on the meaning of the terms together with the description throughout the specification.

In addition, unless explicitly described to the contrary, the word "comprise" and variations such as "comprises" or "comprising" will be understood to imply the inclusion of stated elements but not the exclusion of any other elements. In addition, the terms "-er", "-or", and "module" described in the specification mean units for processing at least one function and/or operation and can be implemented by hardware components or software components and combinations thereof.

It will be understood that when an element or layer is referred to as being "connected to" or "coupled to" another element or layer, it can be directly connected or coupled to the other element or layer or intervening elements or layers may be present. In contrast, when an element is referred to as being "directly connected to" or "directly coupled to" another element or layer, there are no intervening elements or layers present.

Hereinafter, the present disclosure will now be described more fully with reference to the accompanying drawings, in which exemplary embodiments of the present disclosure are shown such that one of ordinary skill in the art may easily work the present disclosure. The disclosure may, however, be embodied in many different forms and should not be construed as being limited to the embodiments set forth herein.

Hereinafter, example embodiments will be described in detail with reference to the accompanying drawings.

FIG. 1 is an exploded perspective view schematically illustrating a coupling relationship between a replaceable cartridge containing an aerosol generating material and an aerosol generating device including the same, according to an embodiment.

An aerosol generating device 5 according to the embodiment illustrated in FIG. 1 includes the cartridge 20 containing the aerosol generating material and a main body 10 supporting the cartridge 20.

The cartridge 20 may be coupled to the main body 10 in a state in which the aerosol generating material is accommodated therein. All or only a portion of the cartridge 20 may be inserted into an accommodation space 19 of the main body 10 when the cartridge 20 is mounted on the main body 10.

After use of the cartridge 20, that is, after all of the aerosol generating material accommodated in the cartridge 20 is exhausted, the cartridge 20 may be separated from the main body 10 and replaced with a new cartridge. Cartridges may contain a different type (e.g., different aroma, different color, or different component, etc.) of aerosol generating material.

The cartridge 20 may contain an aerosol generating material in various forms, such as a liquid state, a solid state, a gaseous state, or a gel state. The aerosol generating material may include a liquid composition. For example, the liquid composition may be a liquid including a tobacco-containing material having a volatile tobacco flavor component, or a liquid including a non-tobacco material.

For example, the liquid composition may include one component of water, solvents, ethanol, plant extracts, spices, flavorings, and vitamin mixtures, or a mixture of these components. The spices may include menthol, peppermint, spearmint oil, and various fruit-flavored ingredients, but are not limited thereto. The flavorings may include ingredients capable of providing various flavors or tastes to a user. Vitamin mixtures may be a mixture of at least one of vitamin A, vitamin B, vitamin C, and vitamin E, but are not limited thereto. In addition, the liquid composition may include an aerosol forming agent such as glycerin and propylene glycol.

For example, the liquid composition may include any weight ratio of glycerin and propylene glycol solution to which nicotine salts are added. The liquid composition may include two or more types of nicotine salts. Nicotine salts may be formed by adding suitable acids, including organic or inorganic acids, to nicotine. Nicotine may be a naturally generated nicotine or synthetic nicotine and may have any suitable weight concentration relative to the total solution weight of the liquid composition.

Acid for the formation of the nicotine salts may be appropriately selected in consideration of the rate of nicotine absorption in the blood, the operating temperature of the aerosol generating device 5, the flavor or savor, the solubility, or the like. For example, the acid for the formation of nicotine salts may be a single acid selected from the group consisting of benzoic acid, lactic acid, salicylic acid, lauric acid, sorbic acid, levulinic acid, pyruvic acid, formic acid, acetic acid, propionic acid, butyric acid, valeric acid, caproic acid, caprylic acid, capric acid, citric acid, myristic acid, palmitic acid, stearic acid, oleic acid, linoleic acid, linolenic acid, phenylacetic acid, tartaric acid, succinic acid, fumaric acid, gluconic acid, saccharic acid, malonic acid or malic acid, or a mixture of two or more acids selected from the group, but is not limited thereto.

The cartridge 20 may be operated by an electrical signal or a wireless signal received from the main body 10 to generate aerosol by converting the phase of the aerosol generating material inside the cartridge 20 to a gaseous phase. The aerosol may refer to a gas in which vaporized particles generated from an aerosol generating material are mixed with air.

For example, the cartridge 20 may convert the phase of the aerosol generating material in response to receiving the electrical signal from the main body 10 by heating the aerosol generating material, by using an ultrasonic vibration method, or by using an induction heating method. The cartridge 20 may include its own power source to convert the phase of the aerosol generating material.

The cartridge 20 may include a liquid storage 21 forming an outer wall of the cartridge 20 and including a space for accommodating the aerosol generating material therein, and an atomizer for converting the aerosol generating material of the liquid storage 21 into aerosol.

When the liquid storage 21 "accommodates the aerosol generating material" therein, it means that the liquid storage 21 functions as a container holding an aerosol generating material and may include an element impregnated with (i.e., containing) an aerosol generating material, such as a sponge, cotton, fabric, or porous ceramic structure.

The atomizer may include, for example, a liquid delivery element (e.g., wick) for absorbing the aerosol generating material and maintaining the absorbed aerosol generating material in an optimal state for conversion to aerosol. The atomizer may also include a heater for heating the liquid delivery element to generate aerosol.

The liquid delivery element may include at least one of, for example, a cotton fiber, a ceramic fiber, a glass fiber, and porous ceramic.

The heater may include a metallic material such as copper, nickel, tungsten, or the like to heat the aerosol generating material delivered to the liquid delivery element by using electrical resistance. The heater may be implemented by, for example, a metal wire, a metal plate, a ceramic heating element, or the like, and may be implemented by a conductive filament, wound on the liquid delivery element, or arranged adjacent to the liquid delivery element, by using a material such as a nichrome wire.

In addition, the atomizer may be implemented by a heating element in the form of a mesh or plate, which absorbs the aerosol generating material, maintains the aerosol generating material in an optimal state for conversion to aerosol without using a separate liquid delivery element, and generates aerosol by heating the aerosol generating material.

The cartridge 20 discharges the aerosol generated from the aerosol generating material therein to the outside of the cartridge 20. The cartridge 20 includes a discharge hole 22*a* for discharging the aerosol to the outside.

The main body 10 may include a connection terminal 10*t* arranged inside the accommodation space 19. When the liquid storage 21 of the cartridge 20 is inserted into the accommodation space 19 of the main body 10, the main body 10 may provide power to the cartridge 20 through the connection terminal 10*t* or supply a signal related to an operation of the cartridge 20 to the cartridge 20.

A holding unit may be installed between the main body 10 and the cartridge 20 to stably maintain the coupling state. The holding unit may include a coupling protrusion 20*g* protruding from an outer surface 21*w* of the liquid storage 21 of the cartridge 20, and a coupling hole 10*g* arranged on a side wall 10*w* surrounding the accommodation space 19 of the main body 10, so that the position of the coupling hole 10*g* corresponds to the coupling protrusion 20*g* when the cartridge 20 is accommodated in the accommodation space 19.

The color of the coupling protrusion 20*g* may be determined according to the type of the liquid composition contained in the liquid storage 21. For example, the color of the coupling protrusion 20*g* may be determined according to the nicotine content of the liquid composition. For another example, the color of the coupling protrusion 20*g* may be determined such that a user may intuitively recognize that a fruit flavor component is contained in the liquid composition.

The user may check the color of the coupling protrusion 20*g* through the coupling hole 10*g*, and may grasp the type of the liquid composition contained in the cartridge 20 from the color of the coupling protrusion 20*g*. Therefore, the user may easily check the type of the cartridge 20 even while the cartridge 20 is inserted into the aerosol generating device 5.

Referring to FIGS. 1 and 7 together, the liquid storage 21 may include a step 21*n* formed in the longitudinal direction of the cartridge 20. A shielding ring 23 may be arranged on a stepped surface of the liquid storage 21. The shielding ring 23 may include an elastic material such as rubber or silicon. For example, the shielding ring 23 may be an O-ring.

The side wall 10*w* of the accommodation space 19 may have a shape corresponding to the step 21*n* of the liquid storage 21 and the shielding ring 23. For example, a step 10*wn* may be formed in the sidewall 10*w* to have a shape corresponding to the step 21*n* of the liquid storage 21. When the cartridge 20 is inserted into the accommodation space 19, the shielding ring 23 may be located in a space between the side wall 10*w* of the accommodation space 19 and the liquid storage 21. The shielding ring 23 may perform a waterproof function in the space between the side wall 10*w* and the liquid storage 21.

Referring to FIG. 1, the liquid storage 21 may include a tapered portion 21*wa* of which width tapers off in the longitudinal direction of the cartridge 20. For example, the cross-sectional area of the tapered portion 21*wa* may decrease toward the end.

As shown in FIG. 8, a portion 10*wa* of the sidewall 10*w* of the accommodation space 19 may be formed such that the tapered portion 21*wa* of the liquid storage 21 fits into the portion 10*wa* of the sidewall 10*w* like a wedge. For example, the portion 10*wa* of the sidewall 10*w* may also have a tapered shape so that the tapered portion 21*wa* of the liquid storage 21 may be fixed.

By forming a portion of the liquid storage 21 in a tapered shape, the cartridge 20 may be fixed to the main body 10 without additional components, thereby reducing the manufacturing cost of the aerosol generating device 5.

However, embodiments are not limited thereto, and various methods may be used to fix the cartridge 20 to the main body 10. For example, the cartridge 20 may be fixed to the main body 10 by using a bracket.

FIG. 2 is a block diagram schematically illustrating a hardware configuration of the aerosol generating device according to the embodiment shown in FIG. 1.

Referring to FIG. 2, the aerosol generating device 10000 may include a battery 11000, a heater 12000, a sensor 13000, a user interface 14000, a memory 15000, and a controller 16000. However, the components of the aerosol generating device 10000 are not limited to the structures illustrated in FIG. 2. According to the design of the aerosol generating device 10000, it will be understood by one of ordinary skill in the art that some of the hardware components shown in FIG. 2 may be omitted or new components may be added.

In an embodiment, the aerosol generating device 10000 may not include a separate cartridge. In this case, the components shown in FIG. 2 may be included in the main body. In another embodiment, the aerosol generating device 10000 may include a main body and a cartridge. In this case, the components shown in FIG. 2 may be included in in the main body and/or the cartridge.

Hereinafter, an operation of each of the components will be described without being limited to a particular location in the aerosol generating device 10000.

The battery 11000 supplies electric power to be used for the aerosol generating device 10000 to operate. For example, the battery 11000 may supply power to heat the heater 12000. In addition, the battery 11000 may supply power required for operation of other components included in the aerosol generating device 10000, such as the sensor 13000, the user interface 14000, the memory 15000, and the controller 16000. The battery 11000 may be a rechargeable battery or a disposable battery. For example, the battery 11000 may be a lithium polymer (LiPoly) battery, but is not limited thereto.

The heater 12000 receives power from the battery 11000 under the control of the controller 16000. The heater 12000 may receive power from the battery 11000 and heat a cigarette inserted into the aerosol generating device 10000, or heat the cartridge mounted on the aerosol generating device 10000.

The heater 12000 may be located in the main body of the aerosol generating device 10000. Alternatively, when the aerosol generating device 10000 consists of the main body and the cartridge, the heater 12000 may be located in the cartridge. When the heater 12000 is located in the cartridge, the heater 12000 may receive power from the battery 11000 located in at least one of the main body and the cartridge.

The heater 12000 may be formed of any suitable electrically resistive material. For example, the suitable electrically resistive material may be a metal or a metal alloy including titanium, zirconium, tantalum, platinum, nickel, cobalt, chromium, hafnium, niobium, molybdenum, tungsten, tin, gallium, manganese, iron, copper, stainless steel, or nichrome, but is not limited thereto. In addition, the heater 12000 may be implemented by a metal wire, a metal plate on which an electrically conductive track is arranged, or a ceramic heating element, but is not limited thereto.

In an embodiment, the heater 12000 may be a component included in the cartridge. The cartridge may include the heater 12000, the liquid delivery element, and the liquid storage. The aerosol generating material accommodated in the liquid storage may be moved to the liquid delivery element, and the heater 12000 may heat the aerosol generating material absorbed by the liquid delivery element, thereby generating aerosol. For example, the heater 12000 may include a material such as nickel or chromium and may be wound around or arranged adjacent to the liquid delivery element.

Meanwhile, the heater 12000 may include an induction heater. The heater 13000 may include an electrically conductive coil for heating a cigarette or the cartridge by an induction heating method, and the cigarette or the cartridge may include a susceptor which may be heated by the induction heater.

The aerosol generating device 10000 may include at least one sensor 13000. A result sensed by the at least one sensor 13000 is transmitted to the controller 16000, and the controller 16000 may control the aerosol generating device 10000 to perform various functions such as controlling the operation of the heater, restricting smoking, determining whether a cigarette (or a cartridge) is inserted, displaying a notification, etc.

For example, the at least one sensor 13000 may include a puff detecting sensor. The puff detecting sensor may detect a user's puff based on a temperature change, a flow change, a voltage change, and/or a pressure change.

The at least one sensor 13000 may include a temperature sensor. The temperature sensor may detect a temperature at which the heater 12000 (or an aerosol generating material) is heated. The aerosol generating device 10000 may include a separate temperature sensor for sensing a temperature of the heater 12000, or the heater 12000 itself may serve as a temperature sensor instead of including a separate temperature sensor.

The at least one sensor 13000 may include a position change detecting sensor. The position change detecting sensor may detect a change in a position of the main body.

The user interface 14000 may provide the user with information about the state of the aerosol generating device 10000. The user interface 14000 may include various interfacing devices, such as a display or a light emitter for outputting visual information, a motor for outputting haptic information, a speaker for outputting sound information, input/output (I/O) interfacing devices (for example, a button or a touch screen) for receiving information input from the user or outputting information to the user, terminals for performing data communication or receiving charging power, and communication interfacing modules for performing wireless communication (for example, Wi-Fi, Wi-Fi direct, Bluetooth, near-field communication (NFC), etc.) with external devices.

However, the aerosol generating device 10000 may be implemented by selecting only some of the above-described various interfacing devices.

The memory 15000 may be a hardware component configured to store various pieces of data processed in the aerosol generating device 10000, and the memory 15000 may store data processed or to be processed by the controller 16000. The memory 15000 may include various types of memories, such as random access memory, such as dynamic random access memory (DRAM), static random access memory (SRAM), etc., read-only memory (ROM), electrically erasable programmable read-only memory (EEPROM), etc.

The memory 15000 may store an operation time of the aerosol generating device 10000, the maximum number of puffs, the current number of puffs, at least one temperature profile, data on a user's smoking pattern, etc.

The controller 16000 is a hardware component configured to control overall operations of the aerosol generating device 10000. The controller 16000 may include at least one processor. A processor can be implemented as an array of a plurality of logic gates or can be implemented as a combination of a general-purpose microprocessor and a memory in which a program executable in the microprocessor is stored. It will be understood by one of ordinary skill in the art that the processor can be implemented in other forms of hardware.

The controller 16000 may analyze a result of the sensing by at least one sensor 13000, and controls various processes subsequently.

The controller 16000 may control power supplied to the heater 12000 so that the operation of the heater 12000 is started or terminated, based on the result of the sensing by the at least one sensor 13000. In addition, based on the result of the sensing by the at least one sensor 13000, the controller 16000 may control the amount of power supplied to the heater 12000 and the time at which the power is supplied, so that the heater 12000 is heated to a predetermined temperature or maintained at an appropriate temperature.

In an embodiment, the controller 16000 may set a mode of the heater 12000 to a preheating mode to start the operation of the heater 12000 after receiving a user input to the aerosol generating device 10000. In addition, the controller 16000 may switch the mode of the heater 12000 from the pre-heating mode to an operation mode after detecting a user's puff by using the puff detecting sensor. In addition, the controller 16000 may stop supplying power to the heater 12000 when the number of puffs reaches a preset number after counting the number of puffs by using the puff detecting sensor.

The controller 16000 may control the user interface 14000 based on the result of the sensing by the at least one sensor 13000. For example, when the number of puffs reaches the preset number after counting the number of puffs by using the puff detecting sensor, the controller 16000 may notify the user by using at least one of a light emitter, a motor, or a speaker that the aerosol generating device 10000 will soon be terminated.

Although not illustrated in FIG. 2, an aerosol generating system may include the aerosol generating device 10000 and a separate cradle. For example, the cradle may be used to charge the battery 11000 of the aerosol generating device 10000. Specifically, the aerosol generating device 10000 may be supplied with power from a battery of the cradle to charge the battery 11000 of the aerosol generating device 10000 while being accommodated in an accommodation space of the cradle.

FIG. 3 is a front view of the cartridge 20, which holds an aerosol generating material and is replaceable, according to the embodiment shown in FIG. 1. FIG. 4 is a side view of the cartridge 20 according to the embodiment shown in FIG. 3. FIG. 5 is a perspective view of the cartridge 20 according to the embodiment shown in FIG. 3.

The cartridge 20, which holds an aerosol generating material, may be replaceable. According to the embodiment shown in FIGS. 3 to 5, the cartridge 20 includes the liquid storage 21 capable of accommodating the aerosol generating material therein, and the discharge hole 22*a* for discharging aerosol to the outside.

The coupling protrusion 20*g* is provided on the outer surface of the side wall 21*w* of the liquid storage 21 of the cartridge 20 as a holding unit for maintaining the coupling between the cartridge 20 and the main body 10. On the lower end of the liquid storage 21 of the cartridge 20, the terminal 21*t* for electrical connection with the main body 10 is provided to be exposed to the outside.

FIG. 6 is a cross-sectional view of the cartridge according to the embodiment shown in FIGS. 3 to 5.

The cartridge 20 may include a liquid storage 21 for accommodating an aerosol generating material therein and an atomizer for converting the aerosol generating material of the liquid storage 21 into aerosol.

The atomizer may include a heater 50, a lower cap 30, and a liquid delivery element 40.

The heater 50 is arranged in the liquid storage 21 and generates aerosol by heating the aerosol generating material. The lower cap 30 surrounds the heater 50 and forms a chamber 49 capable of generating an aerosol. The liquid delivery element 40 is arranged in the chamber 49 of the lower cap 30 so as to be heated by the heater 50, and absorbs the aerosol generating material. The liquid delivery element 40 may maintain the absorbed aerosol generating material, and when the liquid delivery element 40 is heated by the heater 50, the aerosol generating material absorbed in the liquid delivery element 40 is vaporized and aerosol is generated.

The structures of the heater 50, the lower cap 30, and the liquid delivery element 40 shown in FIG. 6 are exemplary and may be modified in various forms. For example, the heater 50 may be arranged adjacent to the liquid delivery element 40 without being wound around the liquid delivery element 40. Also, the structure of the liquid delivery element 40 may be modified into a mesh shape or a plate shape. In addition, the heater 50 and the liquid delivery element 40 may be integrated into one component. For example, the heater 50 and the liquid delivery element 40 may be implemented as a metal heater having a mesh shape.

The lower cap 30 may support the liquid delivery element 40 and the heater 50 and seal the end of the liquid storage 21.

The lower cap 30 may be inserted into the end of the liquid storage 21, and a sealing ring 39 of an elastic material such as rubber or silicon is provided between the lower cap 30 and the liquid storage 21 to improve sealing performance.

The lower cap 30 also includes an air passage 31 for delivering air to the chamber 49. External air may be supplied to the liquid delivery element 40 through the air passage 31 of the lower cap 30.

In the liquid storage 21, a delivery tube 60 is provided to connecting the discharge hole 22*a* with the chamber 49 so that the aerosol generated in the chamber 49 is delivered to the discharge hole 22*a*. The delivery tube 60 is arranged on a central axis line of the liquid storage 21 in the longitudinal direction in which the liquid storage 21 extends. However, the embodiment is not limited thereto, and the position of the delivery tube 60 may be arranged to be biased toward the edge of the liquid storage 21.

A pressurizing portion 70 is arranged between the delivery tube 60 and the liquid delivery element 40. The pressurizing portion 70 is arranged between an end 60*a* of the delivery tube 60 facing the chamber 49 and the liquid delivery element 40, and pressurizes the liquid delivery element 40 toward the lower cap 30.

The pressurizing portion 70 may include an elastic material such as rubber or silicon. The pressurizing portion 70 may be placed between the delivery tube 60 and the liquid delivery element 40 in a compressed state and thus may firmly pressurize the liquid delivery element 40. Due to the pressurizing action of the pressurizing portion 70, the liquid delivery element 40 may be stably maintained in the chamber 49 of the lower cap 30 even after the liquid delivery element 40 is repeatedly heated to generate the aerosol.

The pressurizing portion 70 includes a connecting tube 71 and a contact portion 72. The connecting tube 71 surrounds and supports the end 60*a* of the delivery tube 60 so that the end 60*a* of the delivery tube 60 is connected to the chamber 49. The liquid storage 21 includes a supporting tube 21*s* that surrounds and supports the other end 60*b* of the delivery tube 60 so that the other end 60*b* of the delivery tube 60 is connected to the discharge hole 22*a*.

The delivery tube 60 may include a flange 60*p* protruding from the delivery tube 60 so as to be caught by the connecting tube 71 of the pressurizing portion 70 and by the supporting tube 21*s* of the liquid storage 21.

The contact portion 72 of the pressurization portion 70 extends from the outer side of the connecting tube 71 toward the liquid delivery element 40 to directly contact the liquid delivery element 40, and a material transfer hole 73 formed in the vertical direction outside the contact portion 72 to transfer an aerosol generating material accommodated in the liquid storage 21 to the liquid delivery element 40. The liquid delivery element 40 may be manufactured in a substantially cylindrical shape, and the surface of the contact portion 72 in contact with the liquid delivery element 40 may have a curved shape corresponding to the shape of the outer surface of the liquid delivery element 40.

The coupling protrusion 20*g* may protrude from the outer surface of the side wall 21*w* through the side wall 21*w* of the cartridge 20. The coupling protrusion 20*g* may be stably arranged by being pressed by the lower cap 30 and the side wall 21*w*.

The coupling protrusion 20*g* may include a flange 20*gp* so as not to be detached from the cartridge 20. In addition, the coupling protrusion 20*g* may include an elastic material, such as rubber or silicon, to be easily inserted into the coupling hole 10*g* of the main body 10.

By forming the coupling protrusion 20*g* with a material having elasticity, wear of the main body 10 when the cartridge 20 is coupled to the main body 10 may be reduced. In addition, by mounting the coupling protrusion 20*g* on the cartridge 20 that is a consumable product, when the coupling protrusion 20*g* is worn out, only the cartridge 20 needs to be replaced and the main body 10 may be continuously used.

Unlike the embodiment shown in FIG. 6, the coupling protrusion 20*g* may be integrally formed with other components of the cartridge 20. For example, the coupling protrusion 20*g* may be integrally formed with the lower cap 30. As another example, the coupling protrusion 20*g* may be integrally formed with the side wall 21*w*. Alternatively, the coupling protrusion 20*g* may be provided in the cartridge 20 in such a manner that the coupling protrusion 20*g* is attached to the outer surface of the side wall 21*w*.

By forming a portion 21*wa* of the liquid storage 21 in a tapered shape, the cartridge 20 may be fixed to the main body 10 without additional components, thereby reducing the manufacturing cost of the aerosol generating device.

The effects of the inventive concept are not limited by the contents exemplified above, and more various effects are included in the present specification.

At least one of the components, elements, modules or units (collectively "components" in this paragraph) represented by a block in the drawings such as the controller 16000, the user interface 14000, the sensor 13000 in FIG. 2 may be embodied as various numbers of hardware, software and/or firmware structures that execute respective functions described above, according to an exemplary embodiment. For example, at least one of these components may use a direct circuit structure, such as a memory, a processor, a logic circuit, a look-up table, etc. that may execute the respective functions through controls of one or more microprocessors or other control apparatuses. Also, at least one of these components may be specifically embodied by a module, a program, or a part of code, which contains one or more executable instructions for performing specified logic functions, and executed by one or more microprocessors or other control apparatuses. Further, at least one of these components may include or may be implemented by a processor such as a central processing unit (CPU) that performs the respective functions, a microprocessor, or the like. Two or more of these components may be combined into one single component which performs all operations or functions of the combined two or more components. Also, at least part of functions of at least one of these components may be performed by another of these components. Further, although a bus is not illustrated in the above block diagrams, communication between the components may be performed through the bus. Functional aspects of the above exemplary embodiments may be implemented in algorithms that execute on one or more processors. Furthermore, the components represented by a block or processing steps may employ any number of related art techniques for electronics configuration, signal processing and/or control, data processing and the like.

It should be understood that embodiments described herein should be considered in a descriptive sense only and not for purposes of limitation. Descriptions of features or aspects within each embodiment should typically be considered as available for other similar features or aspects in other embodiments. While one or more embodiments have been described with reference to the figures, it will be understood by those of ordinary skill in the art that various changes in form and details may be made therein without departing from the spirit and scope of the disclosure as defined by the following claims.

The invention claimed is:

1. A cartridge for mounting on a main body of an aerosol generating device, the cartridge comprising a liquid storage extending in a longitudinal direction of the cartridge, the liquid storage comprising a space for accommodating a liquid composition and an outer surface comprising a side wall;

a heater configured to heat the liquid composition accommodated in the liquid storage to generate aerosol, the heater being enclosed within the outer surface of the liquid storage; and a coupling protrusion comprising an elastic material, protruding from the side wall of the outer surface of the liquid storage, and configured to couple the main body to the cartridge by being inserted into a coupling hole formed on the main body.

2. The cartridge of claim 1, wherein a color of the coupling protrusion represents a type of the liquid composition accommodated in the liquid storage.

3. The cartridge of claim 1, wherein the liquid storage comprises a stepped surface formed in the longitudinal direction of the cartridge, and the cartridge further comprises a shielding ring arranged on the stepped surface of the liquid storage.

4. The cartridge of claim 1, wherein the liquid storage comprises a tapered portion of which width tapers off in the longitudinal direction of the cartridge.

5. An aerosol generating device comprising:

a cartridge comprising:

a liquid storage extending in a longitudinal direction of the cartridge, the liquid storage comprising a space for accommodating a liquid composition and an outer surface comprising a first side wall;

a heater configured to heat the liquid composition accommodated in the liquid storage, the heater being enclosed within the outer surface of the liquid storage; and a coupling protrusion comprising an elastic material and protruding from the first side wall of the outer surface of the liquid storage; and a main body comprising:

an accommodation space into which the cartridge is inserted; and a coupling hole arranged on a second side wall surrounding the accommodation space so that the coupling protrusion is inserted into the coupling hole while the cartridge is accommodated in the accommodation space.

6. The aerosol generating device of claim 5, wherein the liquid storage comprises a stepped surface formed in the longitudinal direction of the cartridge, the main body comprises a step formed on an inner wall of the main body and having a shape corresponding to the stepped surface of the liquid storage, and a shielding ring is arranged on the stepped surface of the liquid storage such that the shielding ring is located between the stepped surface of the liquid storage and the step of the inner wall while the cartridge is inserted into the accommodation space.

7. The aerosol generating device of claim 5, wherein the liquid storage comprises a tapered portion of which width tapers off in the longitudinal direction of the cartridge, and an inner wall of the main body has a shape corresponding to the tapered portion of the liquid storage so that the cartridge is wedged in the main body.

* * * * *